US006561101B1

(12) United States Patent
Smith

(10) Patent No.: US 6,561,101 B1
(45) Date of Patent: May 13, 2003

(54) EXPLOSIVE DELAY ASSEMBLY

(75) Inventor: David A. Smith, St. Paul, MN (US)

(73) Assignee: Alliant Techsystems Inc., Edina, MN (US)

( * ) Notice: Subject to any disclaimer, the term of this patent is extended or adjusted under 35 U.S.C. 154(b) by 64 days.

(21) Appl. No.: 09/819,234

(22) Filed: Mar. 28, 2001

(51) Int. Cl.[7] ..... F42C 9/10

(52) U.S. Cl. ..... 102/275.9; 102/275.3; 102/275.11; 102/275.12; 102/202.13; 102/277.2

(58) Field of Search ..... 102/275.1, 275.2, 102/275.3, 275.6, 275.9, 275.11, 275.12, 277.1, 277.2, 202.13

(56) References Cited

U.S. PATENT DOCUMENTS

| | | | | |
|---|---|---|---|---|
| 3,008,414 A | | 11/1961 | Jasse | |
| 3,276,373 A | | 10/1966 | Lyons | |
| 3,830,158 A | | 8/1974 | Di Phillipo | |
| 4,119,040 A | * | 10/1978 | Lerman | 102/277.2 |
| 4,166,418 A | * | 9/1979 | Calder, Jr. | 102/275.3 |
| 4,239,004 A | * | 12/1980 | Day et al. | 102/28 R |
| 4,312,271 A | * | 1/1982 | Day et al. | 102/202.13 |
| 4,667,599 A | * | 5/1987 | Brand | 102/275.12 |
| 4,716,831 A | * | 1/1988 | Bartholomew et al. | 102/273.3 |
| 5,171,935 A | * | 12/1992 | Michna et al. | 102/275.7 |
| 5,413,046 A | * | 5/1995 | Sobczak et al. | 102/275.7 |
| 6,305,287 B1 | * | 10/2001 | Capers et al. | 102/275.3 |

FOREIGN PATENT DOCUMENTS

| | | |
|---|---|---|
| FR | 735 393 A | 11/1932 |
| FR | 1 553 346 A | 1/1969 |
| GB | 577 011 A | 5/1946 |

* cited by examiner

*Primary Examiner*—Peter A. Nelson
(74) *Attorney, Agent, or Firm*—George A. Leone

(57) ABSTRACT

An explosive delay assembly including a housing, the housing includes a continuous elongated sidewall surrounding a region bounded at one end by a top surface, the top surface including an aperture configured for accepting an end booster where the end booster is attached to a ferrule assembly, the end booster and ferrule assembly connected to form a mild detonating fuze including an explosive charge. The elongated sidewalls include a groove emanating from the aperture and threading around the continuous elongated sidewall to a bottom surface and connected to a channel running from the bottom surface to the top surface. The ferrule assembly is wound around the housing within the groove and inserted into the channel to terminate at a top surface region counterbore. The counterbore is filled with an explosive charge.

20 Claims, 4 Drawing Sheets

EXPLOSIVE DELAY ASSEMBLY

BACKGROUND OF THE INVENTION

Modern tandem warheads require an exact time delay between the detonation of individual warheads. System constraints usually require that the delay occur during the warhead detonation sequence. Traditionally delays are implemented by using long lengths, (e.g. 8 feet to 10 feet) of flexible confined detonating cord (FCDC). The flexible confined detonating cord is typically contained in a housing that is attached to one of the warheads. Traditional systems are carried in helicopters and the warheads do not experience the more severe environments experienced in fixed wing aircraft.

Unfortunately, flexible confined detonating cord has a diameter of about 0.25 inches making it undesirable for use in compact spaces requiring relatively longer time delays. Further, devices using flexible confined detonating cord have not been proven to withstand the more severe environments present on fixed wing aircraft. Thus, a more rugged and more compact system is needed to withstand more severe environments such as those found on fixed wing aircraft.

The present invention addresses the shortcomings of presently available explosive delay assemblies by using a much smaller detonating linear product called a mild detonating fuze (MFD) potted into a metallic housing.

SUMMARY OF THE INVENTION

The invention provides an explosive delay assembly including a housing. The housing includes a continuous elongated sidewall surrounding a region bounded at one end by a top surface, the top surface including an aperture configured for accepting an end booster where the end booster is attached to a ferrule assembly, the end booster and ferrule assembly are connected to form a mild detonating fuze including an explosive charge. The elongated sidewalls include a groove emanating from the aperture to a top surface and threading around the continuous elongated sidewall and connected to a channel running from the bottom surface to the top surface. The ferrule assembly is wound around the housing within the groove and inserted into the channel to terminate at a top surface region counterbore. The counterbore is filled with an explosive charge.

In one aspect the invention provides an explosive delay assembly that is designed to withstand more severe flight environments as compared to traditional systems using flexible confined detonating cord.

In another aspect of the invention an explosive delay assembly is comprised of a much smaller detonating linear product called a mild detonating fuze (MDF) potted into a metallic housing, that provides for a 50% increase in delay when compared to a system using flexible confined detonating cord of the same volume.

An advantage of the invention is that it provides an explosive delay assembly that can serve as a secure mounting surface for other warhead components, such as initiation splitting devices and safe, arm and fire devices (SAFD).

In another aspect the invention provides an explosive delay assembly having a mild detonating fuze includes an elongated ferrule having a diameter of less than 0.2 inches and a length for providing a predetermined initiation delay when activated.

DETAILED DESCRIPTION OF THE PREFERRED EMBODIMENTS

Figure 1:
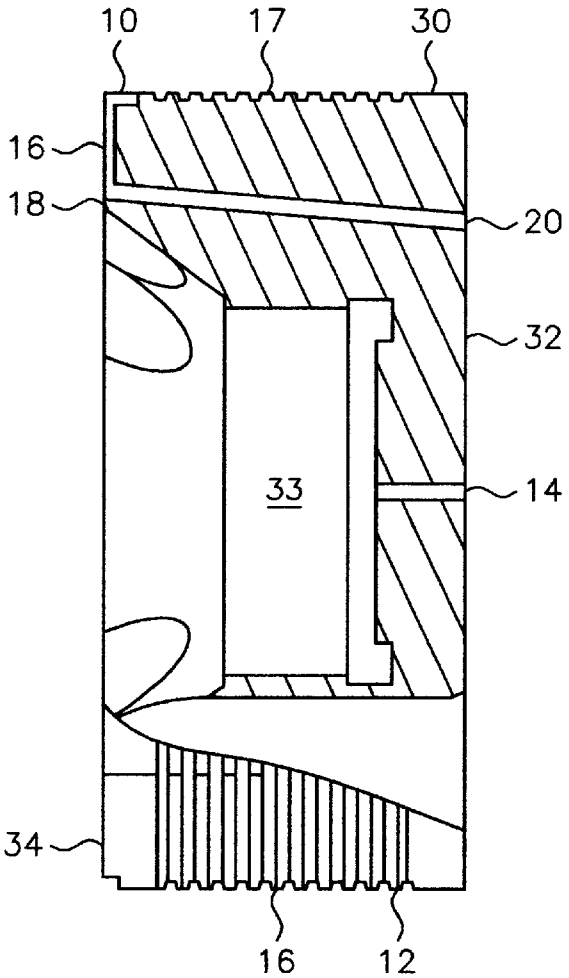
FIG. 1 illustrates a partial cut-away side view schematic of an exemplary explosive delay assembly as used in one embodiment of the invention.

While the invention will be described herein with respect to certain specific useful embodiments, it will be understood that these examples are by way of illustration and that the invention is not limited by these examples. Referring now to FIG. 1, FIG. 1 illustrates a partial cut-away side view schematic of an exemplary explosive delay assembly as used in one embodiment of the invention. There shown is a housing 10 having an outer surface 30 and a groove 12 machined into or otherwise constructed to cover a portion of outer surface 30. A mild detonating fuze 16 is shown inserted into the groove 12 and wrapped around the housing 10. The housing includes a top 32 having a first channel 14. The first channel 14 runs approximately through the center of the top 32 to a chamber 33. The housing also includes a bottom shoulder 34 with a second channel 18 running from the bottom shoulder 34 to the top 32 and terminating in an exit hole 20.

Figure 2:
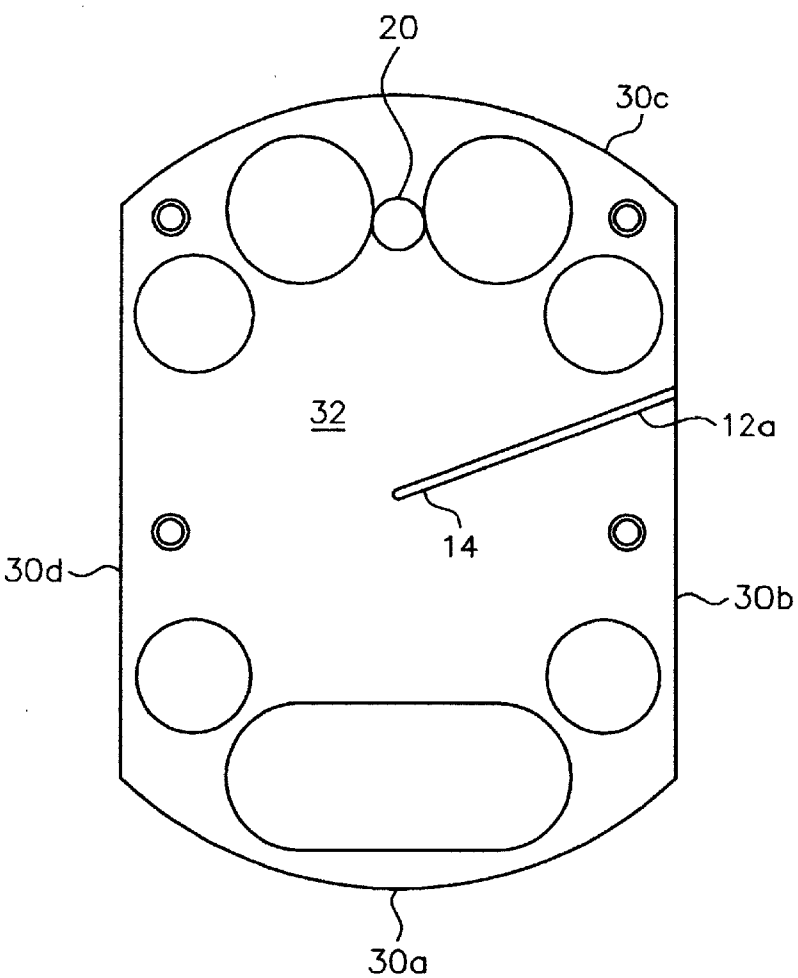
FIG. 2 illustrates a top view schematic of an exemplary explosive delay assembly as used in one embodiment of the invention.

Referring now to FIG. 2, FIG. 2 illustrates a top view schematic of an exemplary explosive delay assembly as used in one embodiment of the invention. The first channel 14 connects to a first groove portion 12*a* of the groove 12. Also illustrated in FIG. 2 is the shape of the sidewall 30. In the exemplary embodiment of the invention shown, the sidewall 30 comprises four contiguous sections 30*a*, 30*b*, 30*c* and 30*d*. Sections 30*a* and 30*c* are generally symmetrically opposing curved surfaces joining linear surfaces 30*b* and 30*d* to form a curvilinear sidewall 30 around the housing 10. It will be apparent to those skilled in the art having the benefit of this disclosure that the shape of the housing 10 may comprise any sidewall surface that is substantially regular so as to allow a grooved channel constructed to accept and hold the mild detonating fuze 16.

In a typical application, the housing 10 can be advantageously shaped to conform to the available volume within a warhead. That is, it can be designed with a shape that fits over a warhead centering cone and inside the warhead's guidance electronics. The housing 10 advantageously comprises metal, preferably aluminum alloy, but may be made from any machinable structural material used in explosive devices. The mild detonating fuze 16 is potted into the groove 12 using well-known potting material 17 (Shown in FIG. 1). The groove 12 may advantageously be machined into the outer surface of the housing. The groove is designed to hold a mild detonating fuze winding long enough for the required delay and to provide protection for the mild detonating fuze in flight and functioning environments.

Figure 3:
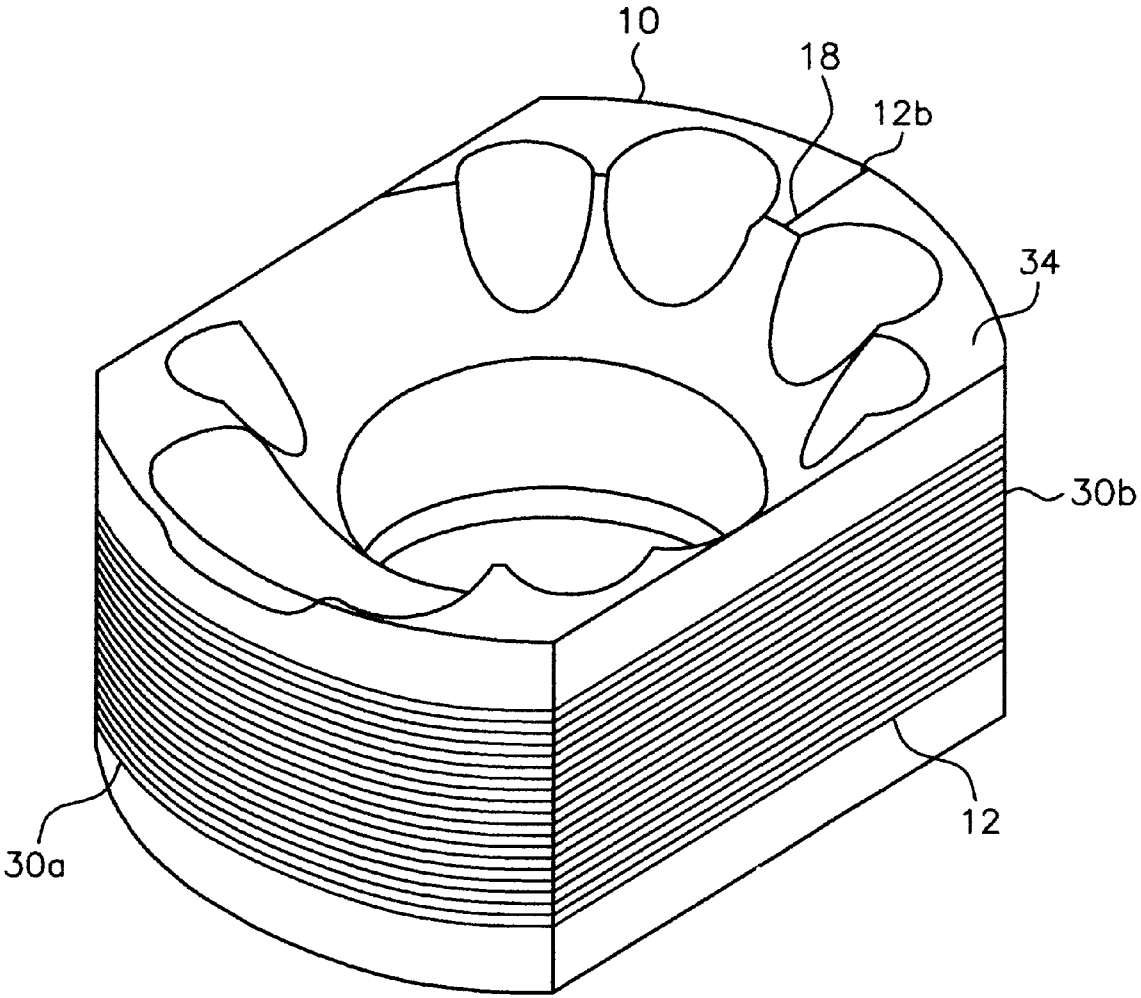
FIG. 3 shows an isometric view showing the bottom features of an example of an explosive delay assembly configuration as contemplated by one embodiment of the invention.

Referring now to FIG. 3, there shown is an isometric view illustrating the bottom features of an example of an explosive delay assembly configuration as contemplated by one embodiment of the invention. The bottom features of housing 10 include a second groove portion 12*b* of groove 12 cut into bottom shoulder 34. The second groove portion 12*b* connects with second channel 18.

Figure 4:
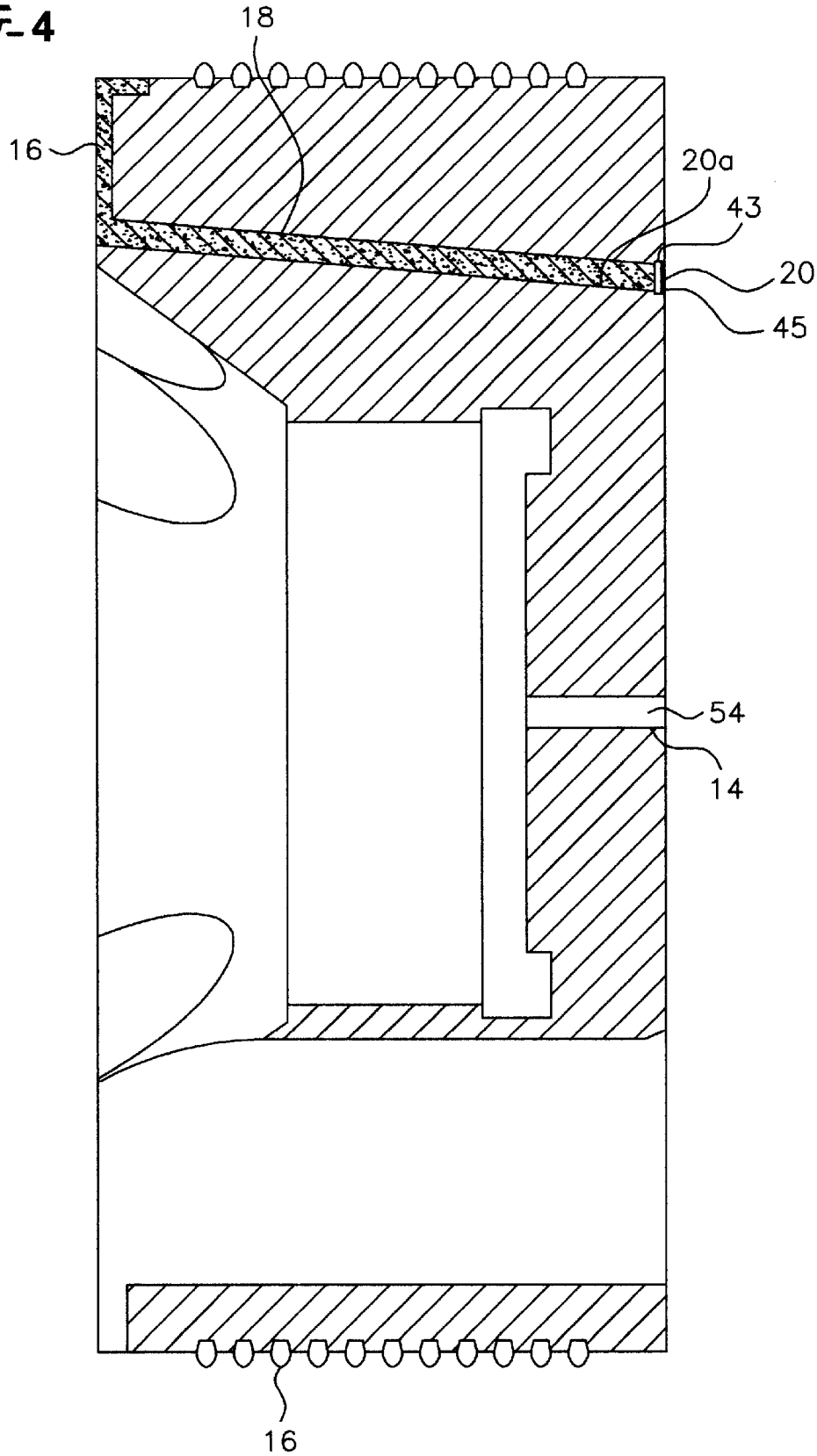
FIG. 4 shows cross-sectional view of an explosive delay assembly configuration as contemplated by one embodiment of the invention.

Referring now to FIG. 4, FIG. 4 shows cross-sectional view of an explosive delay assembly configuration as contemplated by one embodiment of the invention. An explosive delay assembly constructed in accordance with the invention can be made by inserting the mild detonating fuze 16 through the first channel 14 and wrapping the ferrule tube into the groove 12 until the bottom shoulder 34 is reached. The mild detonating fuze 16 is then threaded through the second channel 18 in the housing, exiting at exit hole 20. The exit hole 20 is the EDA initiation point. In one embodiment of the invention as manufactured by Alliant Techsystems Inc. of Hopkins, Minn., the exit hole 20 comprised a 3.175 inch diameter countersink. The mild detonating fuze ferrule is preferably trimmed back to the bottom of the countersink 20*a*. PBXN-5 explosive is pressed into the countersink to provide an initiating charge 43. The initiating charge is protected with a disc of aluminum alloy tape 45. The mild detonating fuze is retained in the groove 12 with potting epoxy. The device is operated by providing a detonating input to the initiating charge. The output is capable of initiating all explosives currently qualified for in-line use by the U.S. military.

Figure 5:
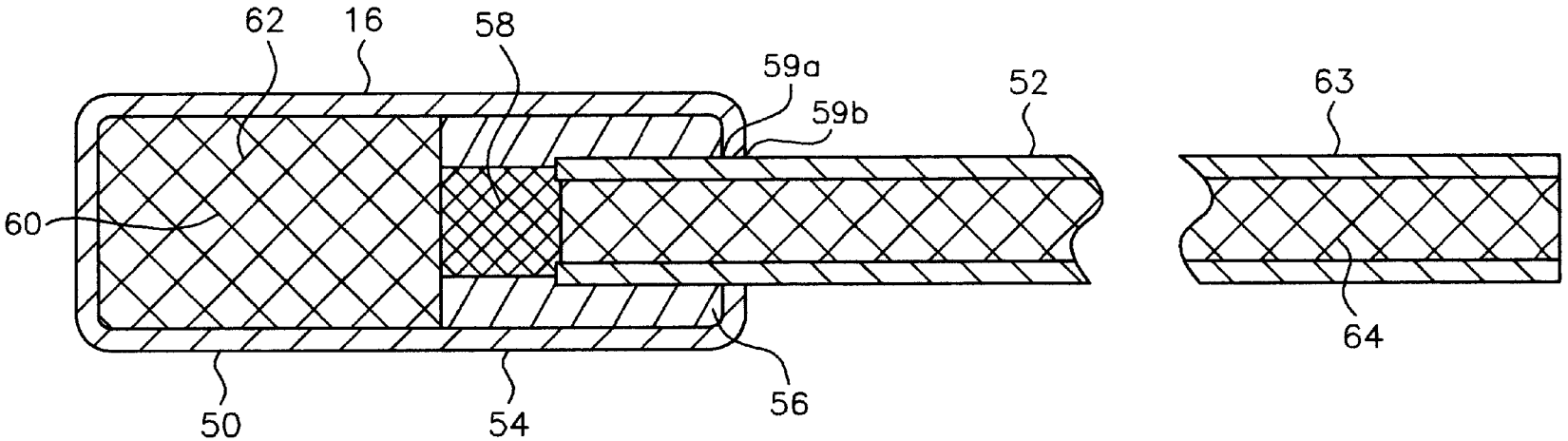
FIG. 5 shows a cross-sectional view of a mild detonating fuze as used in an example of an explosive delay assembly configuration as contemplated by one embodiment of the invention.

FIG. 5 shows a cross-sectional view of a mild detonating fuze as used in an example of an explosive delay assembly configuration as contemplated by one embodiment of the invention. The mild detonating fuze 16 comprises an end booster 50 and a ferrule 52. The end booster 50 includes an end booster cover 54. Contained within the end booster 50 is a collar 56 sized to receive an end of the ferrule at a first end and to hold a first charge 58 in an opposite end. The end booster 50 also has a chamber 60 for holding a second charge 62. In one example embodiment the first charge 58 and the second charge 60 may both comprise well-known explosive PBXN-5 and may be contiguous substantially forming a single charge. The ferrule 52 comprises the winding portion of the mild detonating fuze including a windable tube 63. The windable tube 63 contains a delay charge 64 that may preferably comprise HNS, other explosives, such as PBXN-5 may also be employed for the delay charge. PBXN-5 is a well-known plastic bonded explosive. HNS comprises recrystallized production hexanitrostilbene, $C_{14}H_6N_6O_{12}$ and is well known to those skilled in the art.

In one embodiment of the invention, the mild detonating fuze is constructed with aluminum alloy parts used for the end booster cover 54, the ferrule tube 63 and the collar 56. The collar 56 has an opening 59*a* aligned with a corresponding opening 59*b* in the end booster cover 54 for receiving one end of the ferrule. The ferrule is attached to the end booster by crimping or other equivalent methods. The delay time depends upon the length of the mild detonating fuze according to known relationships. In one aspect the mild detonating fuze can be made with an elongated ferrule having a diameter of less than 0.2 inches, preferably on the order of about 0.060 inches.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment and devices, and that various modifications, both as to the equipment details and operating procedures, may be accomplished without departing from the true spirit and scope of the present invention.

What is claimed is:

1. An explosive delay assembly comprising:

(a) a housing having an outer surface and a groove covering a portion of the outer surface; and (b) a mild detonating fuze wrapped in the groove around the outer surface, wherein the mild detonating fuze includes an elongated ferrule having a diameter of less than 0.2 inches and a length for providing a predetermined initiation delay when activated.

2. The explosive delay assembly of claim 1 wherein the housing comprises:

(a) a top having a first channel, wherein the first channel runs approximately through the center of the top;

(b) a bottom shoulder with a second channel running from the bottom shoulder to the top and terminating in an exit hole; and (c) wherein the exit hole is countersunk and the mild detonating fuze terminates in the exit hole at the countersink and a charge forms an initiation point for the explosive delay assembly.

3. The explosive delay assembly of claim 1 wherein the housing outer surface comprises a curvilinear sidewall around the housing.

4. The explosive delay assembly of claim 1 wherein the housing comprises metal.

5. The explosive delay assembly of claim 1 wherein the housing comprises aluminum alloy.

6. The explosive delay assembly of claim 1 wherein the mild detonating fuze is potted into the groove.

7. The explosive delay assembly of claim 1 wherein the housing comprises a bottom shoulder having a second groove portion of the groove, wherein the second groove portion connects with a second channel 18.

8. The explosive delay assembly of claim 1 wherein the mild detonating fuze comprises an end booster and a ferrule, wherein the end booster includes an end booster cover, and wherein contained within the end booster is a collar sized to receive an end of the ferrule at a first end and to hold a first charge in an opposite end, wherein the end booster also has a chamber for holding a second charge.

9. The explosive delay assembly of claim 8 wherein the first charge and the second charge comprise explosive PBXN-5.

10. The explosive delay assembly of claim 8 the mild detonating fuze comprises an aluminum alloy end booster cover, an aluminum alloy the ferrule tube, and an aluminum alloy collar.

11. An explosive delay assembly comprising:

(a) a housing having i) a curvilinear sidewall around the housing and a groove covering a portion of the curvilinear sidewall, ii) a top having a first channel, wherein the first channel runs approximately through the center of the top, iii) a bottom shoulder with a second channel running from the bottom shoulder to the top and terminating in an exit hole, iv) wherein the exit hole is countersunk and the mild detonating fuze terminates in the exit hole at the countersink and a charge forms an initiation point for the explosive delay assembly; and (b) a mild detonating fuze affixed into the groove and wrapped in the groove around the outer surface, wherein the mild detonating fuze includes an elongated ferrule having a diameter of less than 0.2 inches and a length for providing a predetermined initiation delay when activated.

12. The explosive delay assembly of claim 11 wherein the housing comprises metal.

13. The explosive delay assembly of claim 11 wherein the housing comprises aluminum alloy.

14. The explosive delay assembly of claim 11 wherein the mild detonating fuze is potted into the groove.

15. The explosive delay assembly of claim 11 wherein the housing comprises a bottom shoulder having a second groove portion of the groove, wherein the second groove portion connects with a second channel 18.

16. The explosive delay assembly of claim 11 wherein the mild detonating fuze comprises an end booster and a ferrule, wherein the end booster includes an end booster cover, and wherein contained within the end booster is a collar sized to receive an end of the ferrule at a first end and to hold a first charge in an opposite end, wherein the end booster also has a chamber for holding a second charge.

17. The explosive delay assembly of claim 16 wherein the first charge and the second charge comprise explosive PBXN-5.

18. The explosive delay assembly of claim 17 wherein the mild detonating fuze comprises an aluminum alloy end booster cover, an aluminum alloy the ferrule tube, and an aluminum alloy collar.

19. An explosive delay assembly comprises a housing including a continuous elongated sidewall surrounding a region bounded at one end by a top surface, the top surface including an aperture configured for accepting an end booster wherein the end booster is attached to a ferrule assembly, the end booster and ferrule assembly connected to form a mild detonating fuze including an explosive charge, further the elongated sidewalls include a groove emanating from the aperture to a top surface and threading around the continuous elongated sidewall and connected to a channel running from the bottom surface to the top surface.

20. The explosive delay assembly of claim 19 wherein the ferrule assembly is wound around the housing within the groove and inserted into the channel to terminate at the a surface region counterbore and the counterbore is filled with an explosive charge.

* * * * *